US012228376B2

(12) United States Patent
Teetzel et al.

(10) Patent No.: US 12,228,376 B2
(45) Date of Patent: Feb. 18, 2025

(54) CENTRAL NETWORK CONTROLLER FOR WEAPON ACCESSORY DEVICES

(71) Applicant: WILCOX INDUSTRIES CORP., Newington, NH (US)

(72) Inventors: James W. Teetzel, Portsmouth, NH (US); Elliott S. Turner, Newmarket, NH (US); Mathew A. Reichl, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 18/381,937

(22) Filed: Oct. 19, 2023

(65) Prior Publication Data

US 2024/0255257 A1 Aug. 1, 2024

Related U.S. Application Data

(60) Provisional application No. 63/423,324, filed on Nov. 7, 2022.

(51) Int. Cl.
*F41A 35/00* (2006.01)
*F41G 11/00* (2006.01)

(52) U.S. Cl.
CPC ..... *F41G 11/003* (2013.01); *F41A 35/00* (2013.01)

(58) Field of Classification Search
CPC ..... F41G 11/003; F41G 11/00; F41A 35/00; F41A 99/00; F41C 27/00
See application file for complete search history.

(56) References Cited

U.S. PATENT DOCUMENTS

| | | | | |
|---|---|---|---|---|
| 2010/0031552 | A1* | 2/2010 | Houde-Walter | F41C 23/16 42/72 |
| 2024/0035779 | A1* | 2/2024 | Teetzel | F41C 27/00 |
| 2024/0080647 | A1* | 3/2024 | Musa | F41G 3/18 |

* cited by examiner

*Primary Examiner* — J. Woodrow Eldred
(74) *Attorney, Agent, or Firm* — McLane Middleton, Professional Association

(57) ABSTRACT

A central network controller for a weapon comprises a plurality of computer ports for attaching electronic weapon accessory devices. Each of the computer ports is configured to permit interchangeable use of the electronic weapon accessory devices on a weapon. A processor and an associated electronic memory are operably coupled to the plurality of computer ports. One or more input devices are operably coupled to the processor and are configurable to control operation of an attached one or more of said electronic weapon accessory devices. The central network controller is configured to permit communication between the electronic weapon accessory devices and the processor to permit control of the electronic weapon accessory devices based on input from the one or more input devices. The central network controller is configured to facilitate electronic communication between the electronic weapon accessory devices by mediating transmission of signals between the electronic weapon accessory devices.

27 Claims, 15 Drawing Sheets

CENTRAL NETWORK CONTROLLER FOR WEAPON ACCESSORY DEVICES

CROSS REFERENCE TO RELATED APPLICATION

This application claims the priority benefit of U.S. provisional application No. 63/423,324 filed Nov. 7, 2022. The aforementioned application is incorporated herein by reference in its entirety.

BACKGROUND

The present invention relates to a computer network for weapon accessories and, more particularly, to devices, methods, and systems for integrating weapon accessory devices with data transmission functions for accessory devices using a central network controller.

One problem with current weapon systems is that many of the devices are separate devices having separate processing or control systems. Although one device may include functions or data that would be useful to other devices, such data or functions are not readily available to the other devices due to the separate controllers. In some instances, data from one device may be manually input to another device by the operator. However, such manual entry can be tedious and time consuming.

In some instances, a direct cable connection between two devices may offer a solution. However, a direct cable connection between two specific devices does not ensure universal connectivity with other devices. Furthermore, depending on the number of accessory devices, using multiple direct cable connections can result in a plethora of cables and wiring on the weapon.

Powered accessory rail systems for providing control, data, and power signals between weapon-mounted accessory devices have been considered, but typically require modifying the weapon by replacing the existing handguard/accessory rail.

The present disclosure contemplates a new and improved weapon computer network device that can provide network functionality for a wide variety of weapon and body worn accessory devices.

SUMMARY

A central network controller for a weapon comprises a plurality of computer ports for attaching electronic weapon accessory devices. Each of the computer ports is configured to permit interchangeable use of the electronic weapon accessory devices on a weapon. A processor and an associated electronic memory are operably coupled to the plurality of computer ports. One or more input devices are operably coupled to the processor and are configurable to control operation of an attached one or more of the electronic weapon accessory devices. The central network controller is configured to permit communication between the electronic weapon accessory devices and the processor to permit control of the electronic weapon accessory devices based on input from the one or more input devices. The central network controller is configured to facilitate electronic communication between the electronic weapon accessory devices by mediating transmission of signals between the electronic weapon accessory devices.

In a more limited aspect, the one or more input devices comprise one or more devices selected from the group consisting of a scroll wheel, button-integrated scroll wheel, rocker switch, keypad, multi-position selector switch, and rotary selector switch, and any combination thereof.

In another more limited aspect, the central network controller further comprises one or more port covers, each of the one or more port covers operable to selectively cover one of the computer ports.

In another more limited aspect, the plurality of computer ports includes one or more locking ports. Each of the one or more locking ports comprises a socket defining a receptacle in a housing of the central network controller, the socket configured to receive a complementary plug and a manually actuatable button disposed on the housing. A spring bears against the button and is captured within the housing. A latch member is attached to the button and is movable into and out of the receptacle. The latch member is urged into the receptacle by the spring and the latch member is movable out of the receptacle when the button is pressed to compress the spring. The latch member is configured to engage a complementary groove on the complementary plug when the complementary plug is inserted into the socket to provide a secure engagement of the computer port within the socket.

In another more limited aspect, the complementary plug is selected the group consisting of an electrical connector of an accessory connector cable and a port cover.

In another more limited aspect, the central network controller further comprises a sealing ring disposed within the receptacle.

In another more limited aspect, the central network controller further comprises a radio frequency module configured to interface with a wireless weapon accessory device.

In another more limited aspect, the central network controller further comprises one or both of a microphone and an audio speaker.

In another more limited aspect, the central network controller is operable via voice command.

In another more limited aspect, the central network controller further comprises a housing defining a channel having a cross-sectional shape which substantially matches a cross-sectional profile of a weapon accessory rail interface.

In another more limited aspect, the channel has a cross-sectional shape which substantially matches a cross-sectional profile of a Picatinny accessory rail interface.

In another more limited aspect, the central network controller further comprises a removable retaining bar axially extending within the channel.

In another more limited aspect, the central network controller further comprises electrical contacts disposed within the channel, the electrical contacts positioned to make contact with electrically conductive elements disposed on an associated weapon accessory rail interface when the central network controller is installed on the associated weapon accessory rail interface.

In another more limited aspect, the central network controller further comprises a first removable rail adapter module attachable to the housing within the channel, the first removable rail adapter module having a first configuration of electrical contacts. In the first configuration of electrical contacts, the contacts are positioned to make contact with electrically conductive elements disposed on a first powered weapon accessory rail interface when the central network controller is installed on the first powered weapon accessory rail interface.

In another more limited aspect, the central network controller further comprises a second removable rail adapter module attachable to the housing within the channel, the second removable rail adapter module interchangeably attachable in place of the first removable rail adapter module. The second removable rail adapter module has a second configuration of the electrical contacts, which are positioned to make contact with electrically conductive elements disposed on a second powered weapon accessory rail interface when the central network controller is installed on the second powered weapon accessory rail interface.

In another more limited aspect, the central network controller further comprises a removable blanking plate adapter module attachable to the housing within the channel. The removable blanking plate adapter module is interchangeable with the first and second removable rail adapter modules. The removable blanking plate adapter module is configured to be installed on the housing when the central network controller is mounted on a non-powered weapon accessory rail interface mechanical, non-electrical mount, wherein the blanking plate has no electrical contacts.

In another more limited aspect, the central network controller further comprises a second removable rail adapter module attachable to the housing within the channel. The first removable rail adapter module has an induction coil positioned to facilitate inductive power transfer with an induction coil on a second powered weapon accessory rail interface when the central network controller is installed on the second powered weapon accessory rail interface.

In another more limited aspect, the central network controller further comprises a first inclined surface disposed on the housing and a wedge having a second inclined surface facing and configured to engage with the first inclined surface. A threaded fastener passes through a clearance opening in the wedge and threadably engages a tapped opening disposed within the housing. Advancing the threaded fastener adjusts a position of the wedge relative to the first inclined surface on the device housing for facilitating wedge locking between the housing and the weapon accessory rail interface.

In another more limited aspect, each of the plurality of computer ports is a USB type C port configured to supply and receive power and data from connected ones of the electronic weapon accessory devices.

In another more limited aspect, the central network controller further comprises one or more adaptor cables, each adapter cable having a first connector configured to interface with the plurality of computer ports and a second connector selected from the group consisting of legacy connectors, proprietary connectors, and non-standard connectors, and battery dummies.

In another more limited aspect, the central network controller further comprises an adapter cable having a first end having a USB connector configured for connection to the central network controller and a second end having dual USB connectors, each USB connector being configured for connection to two electronic weapon accessory devices, wherein the adapter cable is adapted to facilitate simultaneous data communication between the central network controller and the electronic weapon accessory devices.

In another more limited aspect, the central network controller further comprises a battery adapter and a battery.

In another more limited aspect, the battery is a small tactical universal battery (STUB).

In another more limited aspect, the central network controller further comprises a radio configured to be detachably coupled to one of the computer ports.

In another more limited aspect, the central network controller further comprises a circuit board and one or more modules disposed on the circuit board. The one or more modules are selected from the group consisting of an inertial measurement unit (IMU), a short-range radio frequency (RF) transceiver, cellular modem, laser driver circuit, image signal processor, GPS receiver, power management integrated circuit (PMIC), video recorder module, and any combination thereof.

In another more limited aspect, the central network controller further comprises a mounting adapter assembly for attaching to a webbing attachment system. The mounting adapter assembly comprises a battery compartment for receiving a battery for supplying power to the central network controller. The battery compartment is configured to detachably couple to a housing of the central network controller. An attachment plate is attached to the battery compartment and is configured to be positioned behind a webbing structure of the webbing attachment system.

In another more limited aspect, the central network controller further comprises a housing and an axially extending dovetail disposed on the housing. A rail fastener assembly includes a base having an axially extending slot slidably receiving the axially extending dovetail. First and second axially spaced apart hooks are configured to detachably engage a weapon accessory rail interface.

One advantage of certain embodiments of the disclosed development resides in its ability to enable seamless integration and intuitive operator control over numerous common, disparate systems and technologies connected through a multitude of different methods. In certain embodiments, the small, modular design allows the system to be mounted on a variety of different locations, including a user's weapon, vest, backpack, etc.

Another advantage of certain embodiments of the disclosed development is the increased capability resulting from integrating systems together. For example, a laser range finding system can feed a ballistic solution to a thermal sight for a disturbed reticle solution while simultaneously streaming thermal weapon video to an enhanced situational awareness system via a data radio.

Another advantage of certain embodiments of the disclosed development is the capability of providing power to all components attached by cables from a common power source.

Still other benefits and advantages of the present development will become apparent to those of ordinary skill in the art upon reading and understanding the following specification.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used on another embodiment to yield a still further embodiment. Likewise, one could implement numerous alternate embodiments, using either current technology or technology developed after the filing date of this patent application, which would still fall within the scope of the claims. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention, and are not intended to limit the structure thereof to any particular position or orientation.

All numbers herein are assumed to be modified by the term "about," unless stated otherwise. The recitation of numerical ranges by endpoints should be understood to include all numbers subsumed within that range (e.g., 1 to 5 includes 1, 1.5, 2, 2.75, 3, 3.80, 4, and 5), except where stated otherwise or where the context precludes such an understanding.

Figure 1:
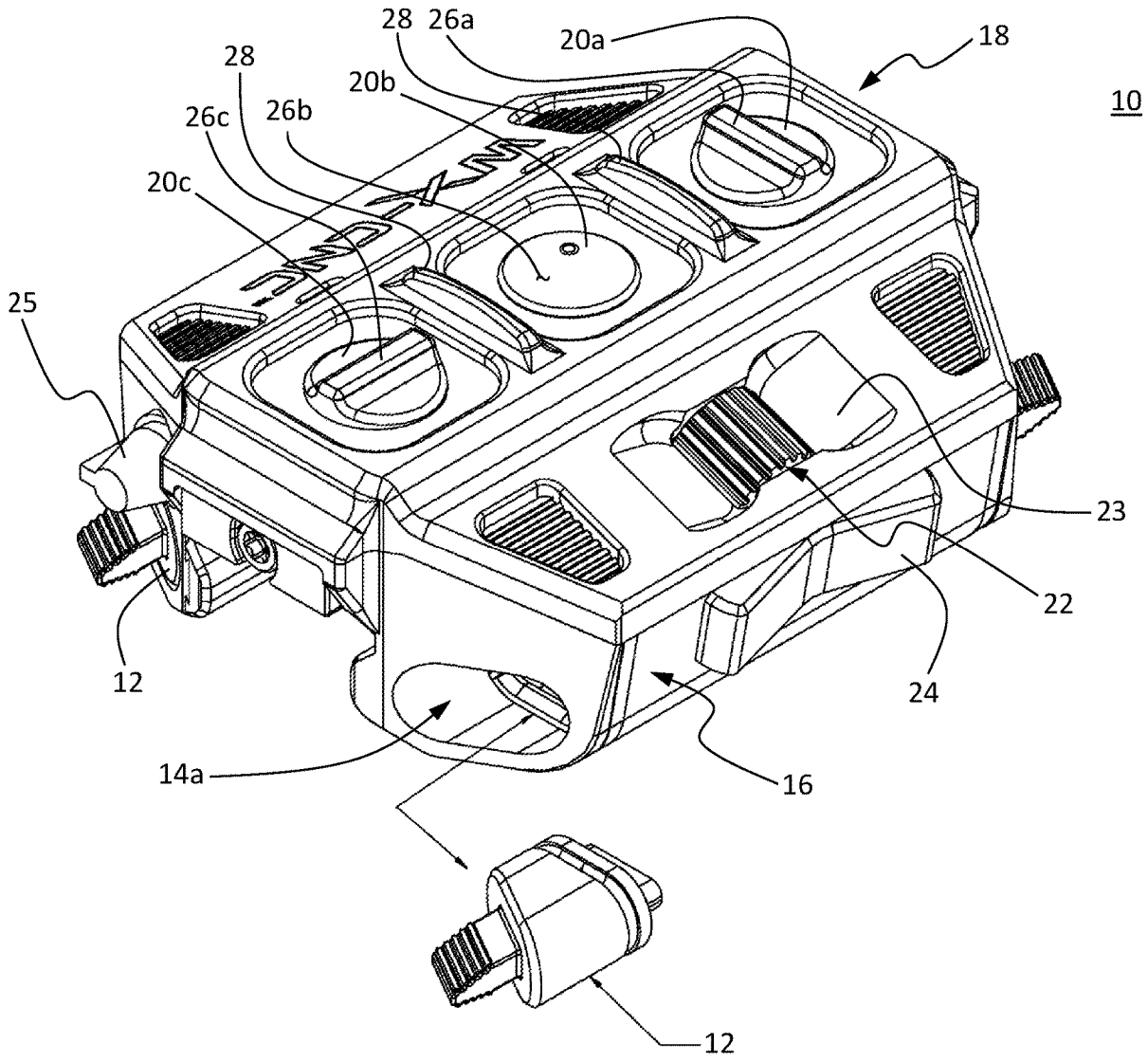
FIG. 1 is an isometric view of the central network controller in accordance with an exemplary embodiment, with detail of a locking dust cover plug.

FIG. 1 illustrates a central network controller 10 in accordance with an exemplary embodiment, with detail of a locking dust cover plug 12 for computer ports 14*a*. In addition to shielding the ports 14*a* from dust and debris when cable plug is not attached, the plugs 12 also protect against entry of moisture and water as well as providing physical protection to the ports 14*a*, e.g., by preventing accidental damage or impact to the ports 14*a*. In the illustrated embodiments, the computer ports 14*a* comprise four USB type C ports disposed at each corner of a housing 16. In embodiments, the computer ports further include additional ports 14*b* (see FIG. 2A) on a side of the housing 16.

The unit 10 further includes manually actuatable input devices that may be employed to perform or provide access to particular functions on an attached weapon accessory device. As used herein, the term "attached" is intended to include accessory devices that are connected to the unit 10 via one of the computer ports 14*a*, 14*b*, as well as accessory devices having a wireless transceiver for which a wireless communication channel has been established between such wireless accessory device and the unit 10 via the RF module 106 (see FIG. 10A), such as a Bluetooth module, Wi-Fi module, Near Field Communication (NFC) module, or other wireless communication module.

In embodiments, the input devices include a keypad 18 comprising depressible buttons 20*a*, 20*b*, 20*c*, a scroll wheel 22, and a double button or three-position rocker switch 24. A plurality of buttons or keys (three buttons in the embodiment shown) on the keypad 18 can be used to activate lights, lasers, rangefinders, cameras, and communication devices, to navigate menu-based user interfaces on head up displays or other electronic accessory device displays, to interface with mobile electronic devices such as smart phones, smart watches, tablets, or other computational platforms, and so forth.

In embodiments, the buttons 20*a*, 20*b*, and 20*c* include surface features to provide a distinguishable tactile feel. In the illustrated embodiment, the button 20*a* includes a transverse ridge 26*a*, the button 20*b* includes a smooth, dome-shaped surface 26*b*, and the button 20*c* includes an axially-extending ridge 26*c*. Partitions 28 disposed between the buttons 20*a*, 20*b*, and 20*c* provide ease of use using a gloved hand.

The double button or three-position rocker switch 24 has three states (increment, neutral, and decrement) and is advantageously used to control accessory device functions or parameters that can be incremented or decremented. For example, the input device 24 could be used to adjust a laser output intensity up or down, navigate through a hierarchal menu-based user interface, or the like.

Figure 10B:
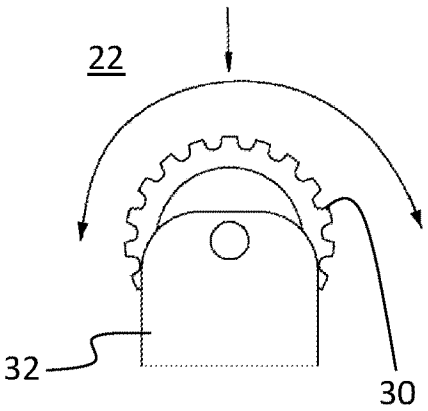
FIG. 10B illustrates the manner of operation of the scroll wheel.

In embodiments, the scroll wheel 22 is a depressible, i.e., button-integrated, scroll wheel including a rotatable portion 30 and depressible button portion 32 (see FIG. 10B). The scroll wheel 22 is advantageously used to navigate through a hierarchal menu-based user interface, wherein the wheel portion is used to highlight a desired menu item and the depressible button portion is used to select the highlighted menu option or activate a desired function. A multi-position selector switch 25, such as a rotary switch, is provided to select which attached device is controlled using the input devices 18, 22, 24 by turning the knob to the desired position. In embodiments, the scroll wheel 22 is recessed within a wheel well 23 on the housing 16 to prevent inadvertent actuation of the scroll wheel 22.

Figure 2B:
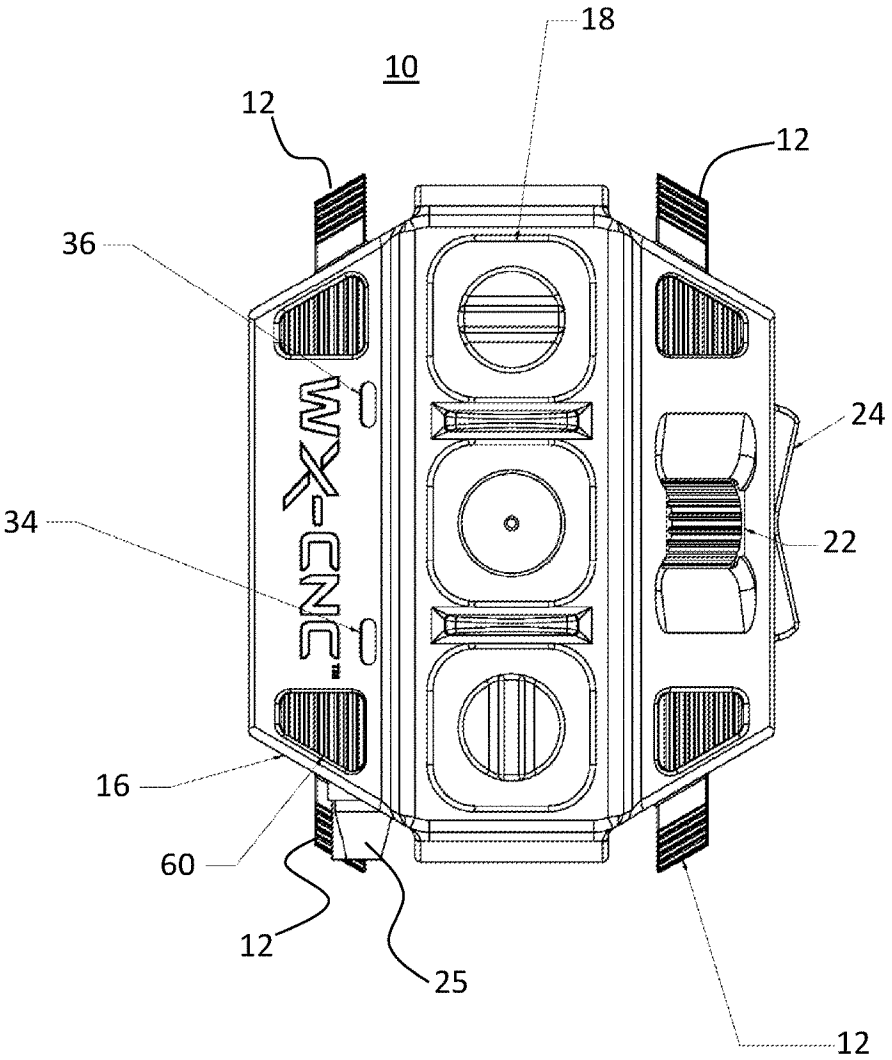
FIGS. 2A and 2B are side and top views of the central network controller appearing in FIG. 1.
Figure 2A:
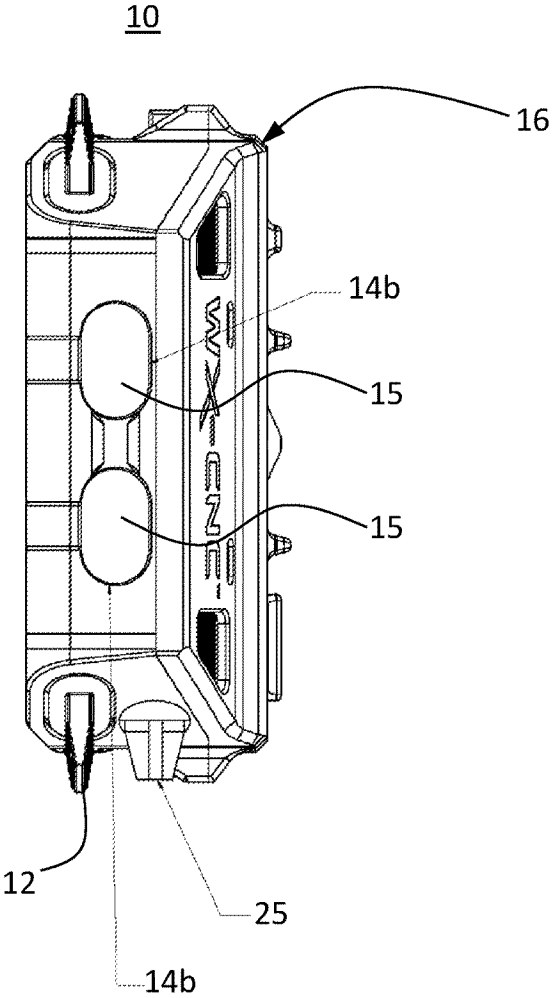

Referring now to FIGS. 2A and 2B, and with continued reference to FIG. 1, two computer ports 14*b* are disposed on the side of the housing 16 and have removable, preferably hinged or tethered, dust covers 15. The computer ports 14*b* are advantageously used for temporary connections, whereas, the ports 14*a* are advantageously used for accessory devices that are intended to remain attached for longer term.

A microphone 34 and audio speaker 36 are disposed on an upper surface of the housing 16. In embodiments, the microphone is configured to be used in connection with a voice recognition module (not shown) for voice recognition of the user. In embodiments, the microphone is configured to receive voice command input for control of an attached accessory device, e.g., "turn on flashlight, half power." Exemplary voice command modules include an associated analog-to-digital converter (ADC), digital signal processor (DSP), voice recognition software, which may be implemented in hardware, software, or firmware. In embodiments, the microphone can be utilized as a ground sensor and stream captured sound to an enhanced situational awareness system via a tactical radio or an onboard modem.

In embodiments, the scroll wheel 22 is used to interface with a connected system and serves as both a scroll device and a button. Functions the scroll wheel 22 serves include but are not limited to scrolling through device menus, increasing and decreasing brightness of lasers, illuminators, flashlights, or the like, increasing and decreasing brightness of display screens, changing laser aim points, zeroing electro-optics, adjusting camera focus, changing communications channels, activating and controlling various sensors.

In embodiments, functions that the toggle up and down switch 24 serves include but are not limited to scrolling through device menus, increasing and decreasing brightness of lasers, illuminators, flashlights, or the like, increasing and decreasing brightness of display screens, changing laser aim points, zeroing electro-optics, changing communications channels, and activating and controlling various sensors.

In embodiments, the keypad 18, scroll wheel 22, and toggle up and down switch 24 are user programmable, e.g., via a software application on a device coupled to the central network controller 10. For example, in embodiments, a user definable key map is associated with the keypad 18 that assigns specific functions to each button or key.

Referring now to FIGS. 3A, 3B, 4A, and 4B, and with continued reference to FIGS. 1, 2A, and 2B, the central network controller 10 can be adapted for use with a powered accessory rail interface via a selected one of the powered rail adapters 40*a*-40*e* or with a non-powered accessory rail interface using a blank module rail adapter 40*f*. The adapters 40*a*-40*e* are user configurable to function with any existing or future powered rail allowing the device to distribute power to connected devices. The adapters 40*a*-40*d* include a plurality of electrical contact pins 41, such as spring loaded or pogo pins for power and ground for powered rail interfaces and for power, ground, and data for powered rail interfaces with power and data transmission capabilities. Exemplary powered rail systems include powered rail platforms from Wilcox Industry Corp. of Newington, NH or T-Worx Holdings of Sterling, VA.

The adapters 40*a* and 40*d* each include three pins 41. In embodiments, the adaptors 40*a* and 40*d* are alternate configurations of a three pin power adaptor. Alternately, the adaptors 40*a* and 40*d* are three-pin connector designed to transmit both power and data, e.g., wherein the third pin serves as a common ground reference. The adapter 40*b* includes two pins 41. In embodiments, the adaptor 41 serves as a two pin power connector, e.g., a T-Worx style power adaptor. The adapter 40*c* includes four pins 41. In embodiments, the adaptor 40*c* is a four-pin power adaptor with both power and data transmission capabilities. In embodiments, the pins 41 of the adaptor 40*c* include two pins for power (e.g., Vcc and GND) and two additional pins for data communication.

The adaptor 40*e* includes an induction coil 43 instead of electrical contact pins. In embodiments, the adaptor 40*e* provides wireless electrical energy to a receiving device.

Figures 3A, 3B:
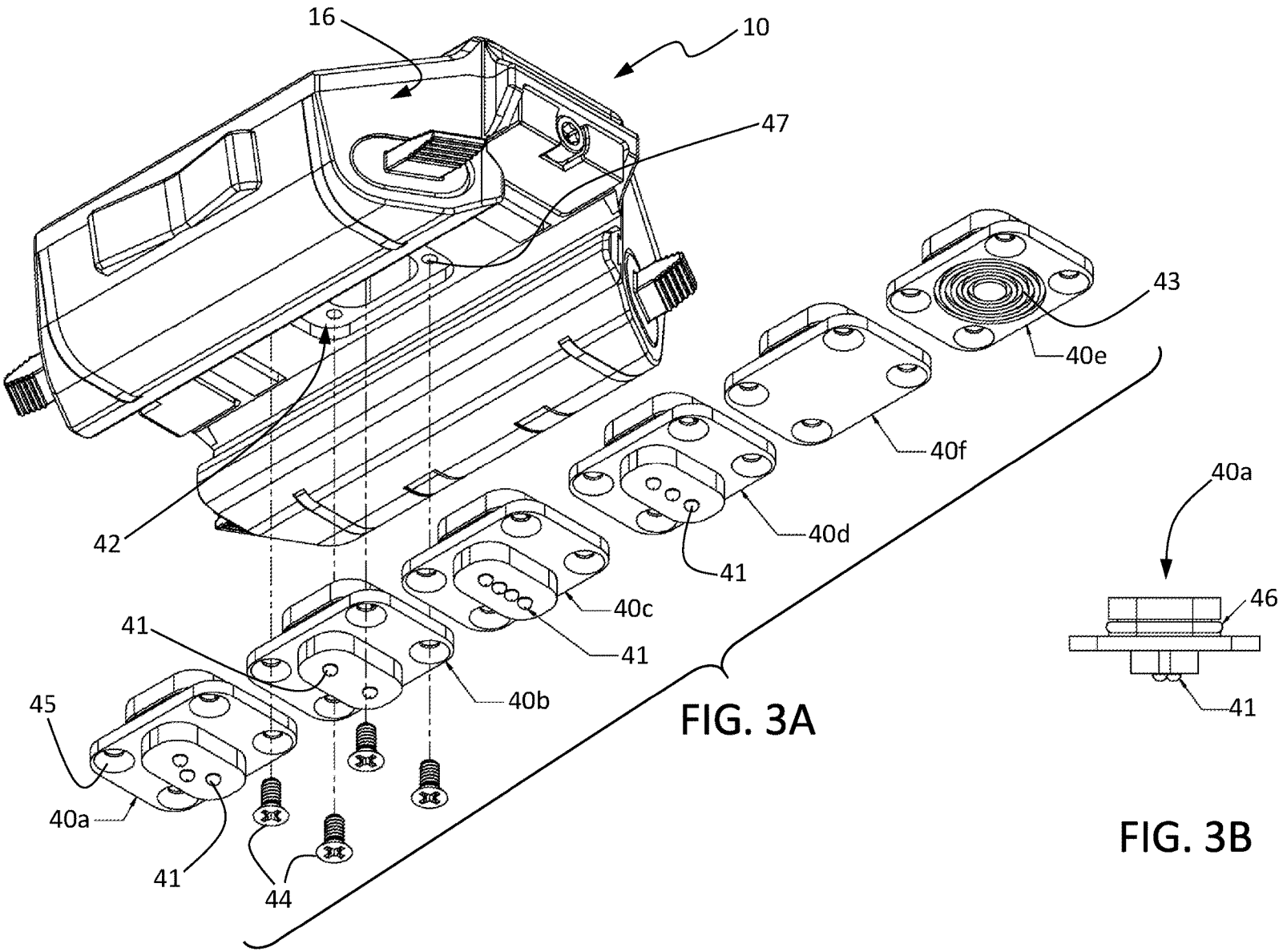
FIG. 3A is an isometric view of the central network controller appearing in FIG. 1 taken generally from the bottom, illustrating a plurality of interchangeable powered rail adapters.
FIG. 3B is an end view of an exemplary powered rail adapter.

The adapters 40*a*-40*f* interchangeably engage a complementary receptacle 42 on the housing 16 and are detachably secured using fasteners 44, which pass through clearance openings 45 in the adaptors 40*a*-40*f* and engage tapped openings 47 in the receptacle 42. FIG. 3B is a side view of the adapter 40*b* and illustrates a sealing ring 46 for resisting entry of moisture or other external contamination into the housing 16.

Figure 4B:
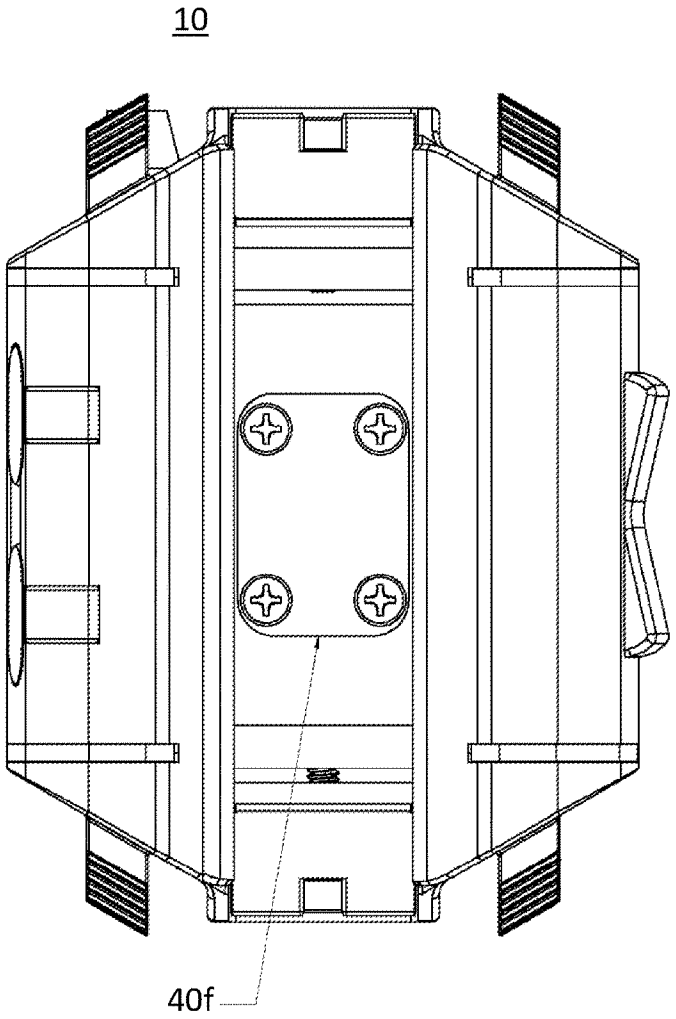
FIGS. 4A and 4B are bottom views of the central network controller appearing in FIG. 1, with a modular powered and non-powered rail adapter, respectively.
Figure 4A:
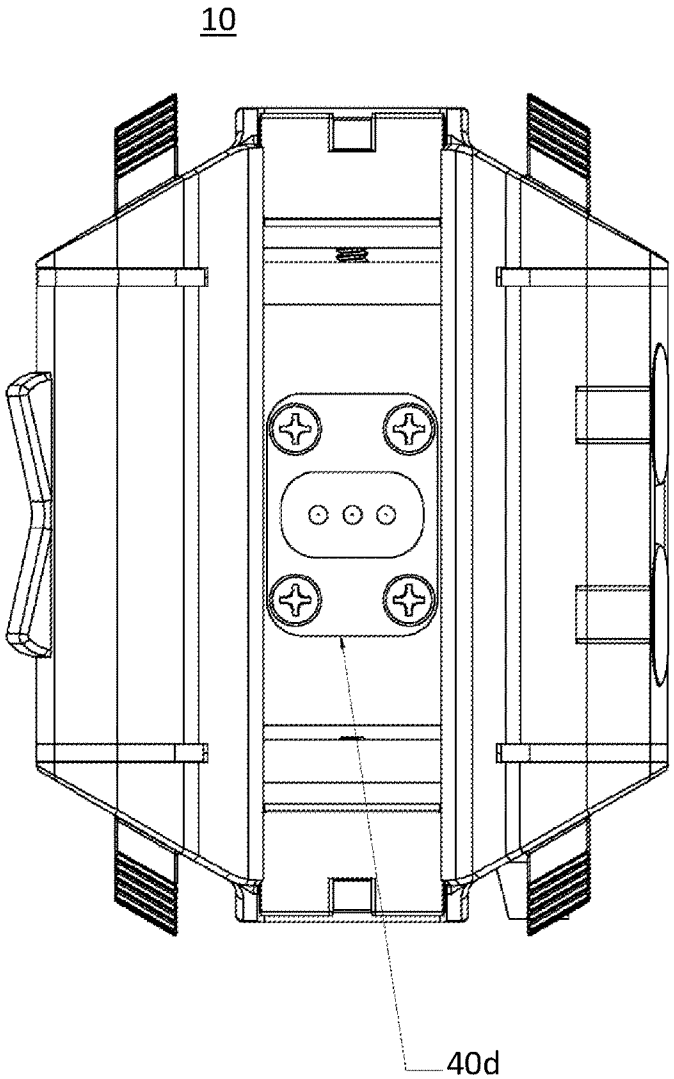

FIGS. 4A and 4B are bottom views of the central network controller 10 in two different powered rail configurations. FIG. 4A shows the unit 10 with the powered rail adaptor 40*d*. FIG. 4B shows the unit 10 with the blanking plate 40*f*. The blanking plate is used when the central network controller is attach to a non-powered rail. In addition to a powered rail, powered may be supplied to an accessory device via power source attached via any of the computer ports 14*a*, 14*b*. The power source can be chargeable or non-rechargeable sources. The power may come from a standalone battery, a generator, solar charging device, vehicle power system, building power system, or any other available power source. In FIG. 4A, the illustrated embodiment is shown rotated 180 degrees relative to the configuration shown in FIG. 4B, thus illustrating the ambidextrous characteristics of the unit 10.

Figure 5B:
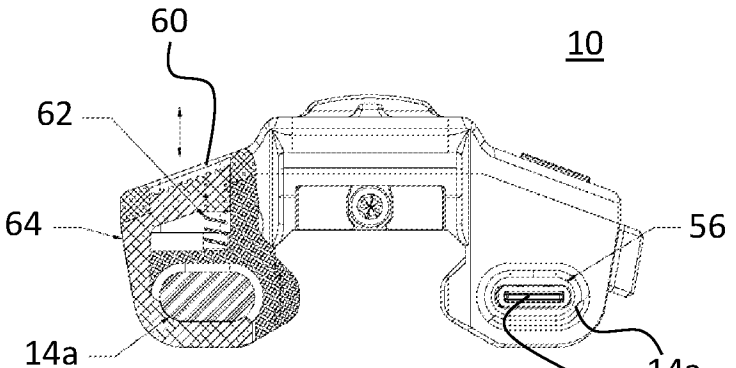
FIGS. 5B and 5C are partial cross-sectional views of the central network controller appearing in FIG. 1, illustrating the sealed and locked USB-C connector mechanism.
Figure 5C:
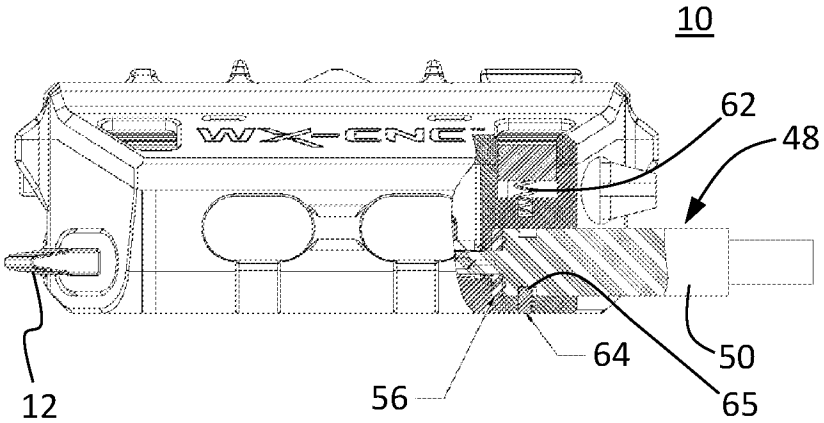
Figure 5A:
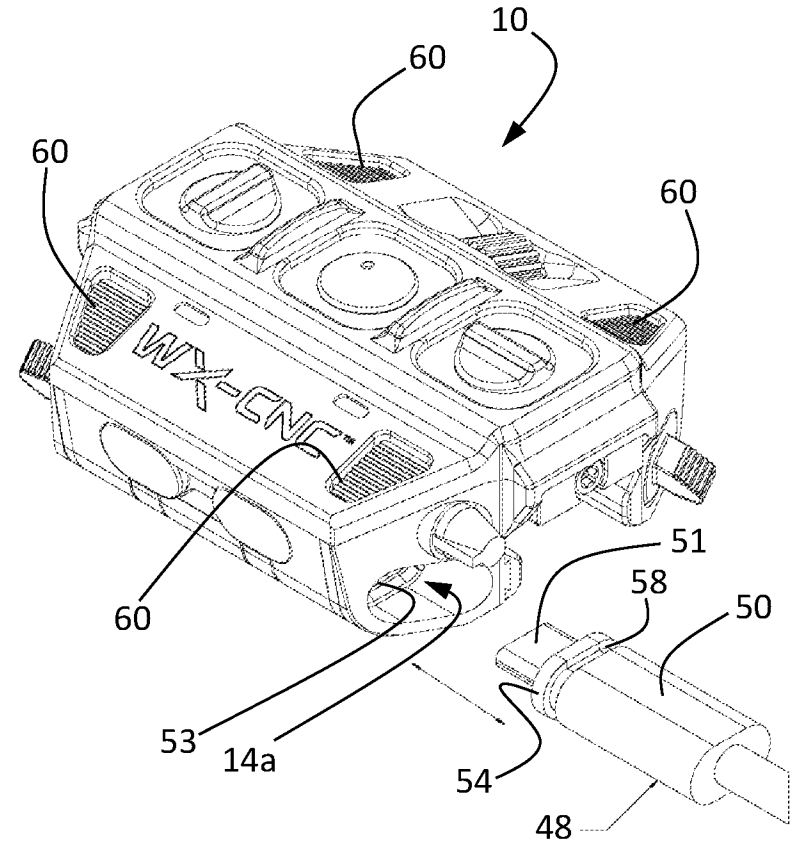
FIG. 5A is an isometric view illustrating the sealed and locked USB-C connector mechanism.
Figure 6B:
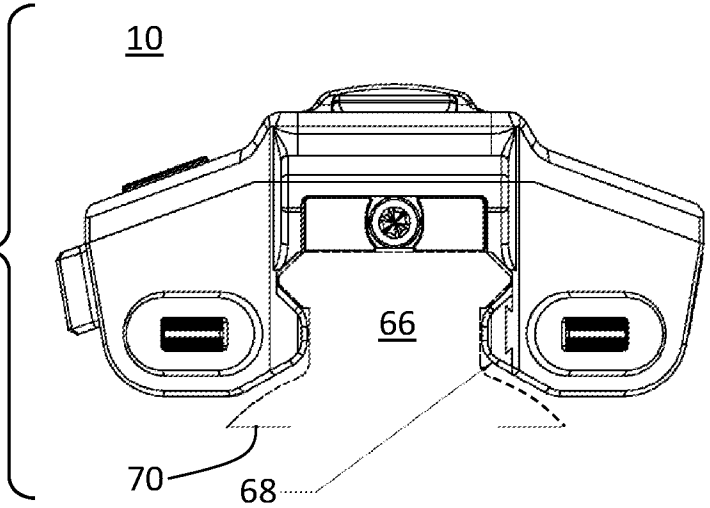
FIGS. 6B and 6C are end views with the removable rail section attached and detached, respectively.
Figure 6C:
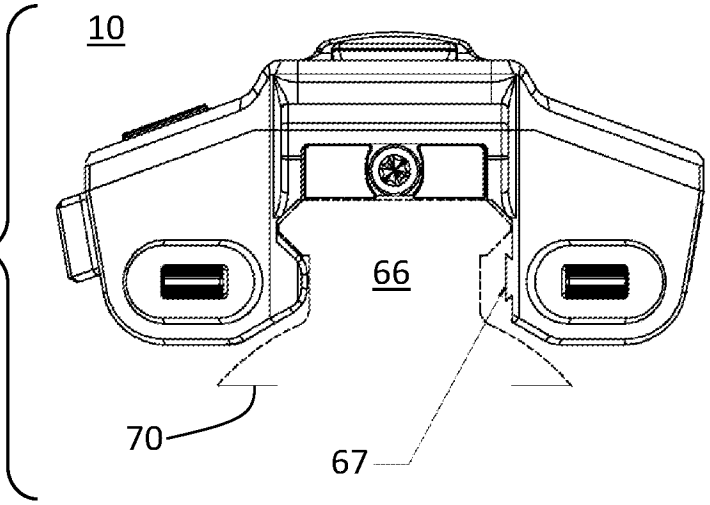
Figure 6A:
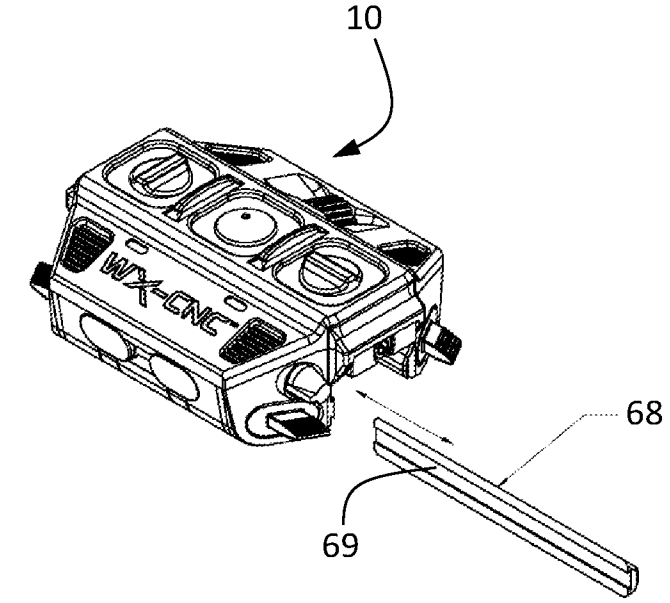
FIG. 6A is an isometric view illustrating a removable rail section for engaging a weapon accessory rail.

Referring now to FIGS. 5A-5C, and with continued reference to FIGS. 1, 2A, 2B, 3A, 3B, 4A, and 4B, there appears isometric and partial cross-sectional views of the central network controller 10, illustrating the sealed and locked USB-C connector mechanisms, which are disposed generally at each of the four corners of the central network controller 10. In certain embodiments, the sealing members are configured to provide a hermetic seal.

A connector 48 includes a connector housing 50 and is received in the port receptacle 14*a* in the housing 16. The connector housing 50 includes a shoulder 54 which engages a face seal 56 disposed in the receptacle 14*a*. The connector housing 50 further includes a recess 58, preferably an annular channel or groove formed in the connector housing 50. A plug portion 51 is received within a socket portion 53 disposed within the receptacle 14*a*.

The connector 48 is locked into the port 14*a* using a spring-loaded hook or latch mechanism. To disconnect the connector 48 from the port 14*a*, the user depresses a button 60 on the upper surface of the housing 16 against the urging of a biasing spring 62. A locking hook 64 extends between the button 60 and the lower surface of the connector housing 50. The distal end of the hook 64 engages the recess 58 when the connector 48 is inserted into the port receptacle 14*a*. The spring 62 biases the hook 64 into the recess 58. A connection is achieved by pushing the connector into the housing until an audible click is heard. A ramped or beveled surface 65 may be provided on the leading edge of the hook 64 to facilitate insertion of the plug 48 past the hook 64 while resisting withdrawal of the plug unless the button 60 is depressed. To remove the connector 48 from the port 14*a*, button 60 is depressed against the urging of the spring 62 to move the hook 64 downward and out of the recess 58, and the connector 48 is pulled out.

Referring now to FIGS. 6A-6C, 7A, and 7B, and with continued reference to the remaining figures, there is illustrated a rail attachment mechanism for detachably affixing the central network controller 10 to a Picatinny (e.g., MIL-STD 1913 or NATO equivalent) accessory rail 70. The device 10 has a channel 66 having cross-sectional shape which corresponds to the cross-sectional profile of a weapon rail interface, such as a Picatinny rail profile, incorporated into the housing 16, with a removable section 68, i.e., retention bar, which completes the profile 66. The retention bar 68 is attached via an axial dovetail member 67, which slidably engages an axial dove tail slot 69. When it is possible to slide the central network controller housing 16 onto the accessory rail 70 from an end, the removable section 68 may be left in place. When sliding the device onto the rail 70 is not an option, e.g., where there is a scope or other accessory device attached to the rail that would prevent sliding the unit 10 into the rail, removal of the removable section 68 allows the central network controller 10 to be cantilevered over the accessory rail 70. The removable section may then be axially slid into position with the controller 10 in place on the rail 70.

Figure 7B:
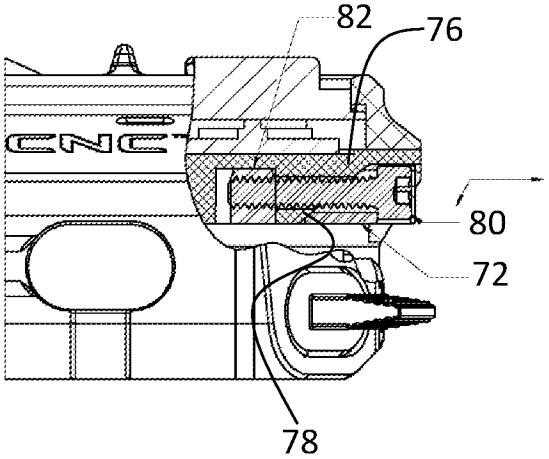
FIGS. 7A and 7B are isometric, fragmentary, partial cross-sectional views, respectively, illustrating a rail lock wedge system.
Figure 7A:
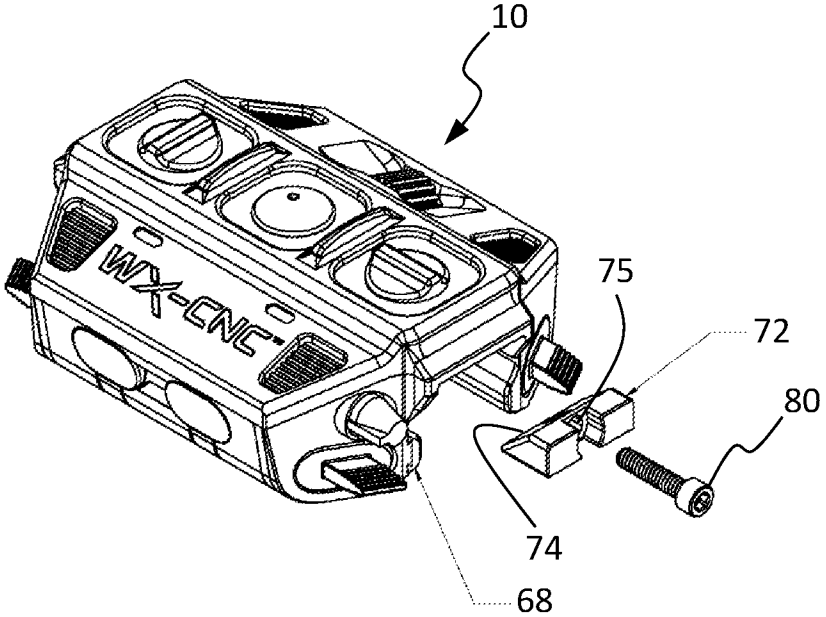

As best seen in FIGS. 7A and 7B, a wedge lock assembly includes a first wedge member 72 having a first beveled edge 74 and a second wedge 76 member having a second beveled surface 78. The first beveled edge and the second beveled edge are aligned, facing, and generally coplanar. The first wedge member is movable and the second wedge member is secured in fixed position adjacent the Picatinny profile 66. A threaded fastener 80 passes through a clearance opening 75 in the wedge and engages an internally threaded member 82 disposed in the housing 16 to selectively advance or retract the first wedge member 72 toward or away from the housing 16, depending on the direction of rotation of the threaded fastener 80. The unit 10 is locked into position on the rail 70 as the first wedge member 72 is advanced toward the second wedge member 76. The accessory rail 70 may be any rail system having a T-shaped cross-sectional shape, and preferably is of the type having a plurality of transverse mounting projections extending perpendicular to the longitudinal axis of the rail and separated by a plurality of transverse recoil grooves as would be understood by persons skilled in the art.

Figure 8:
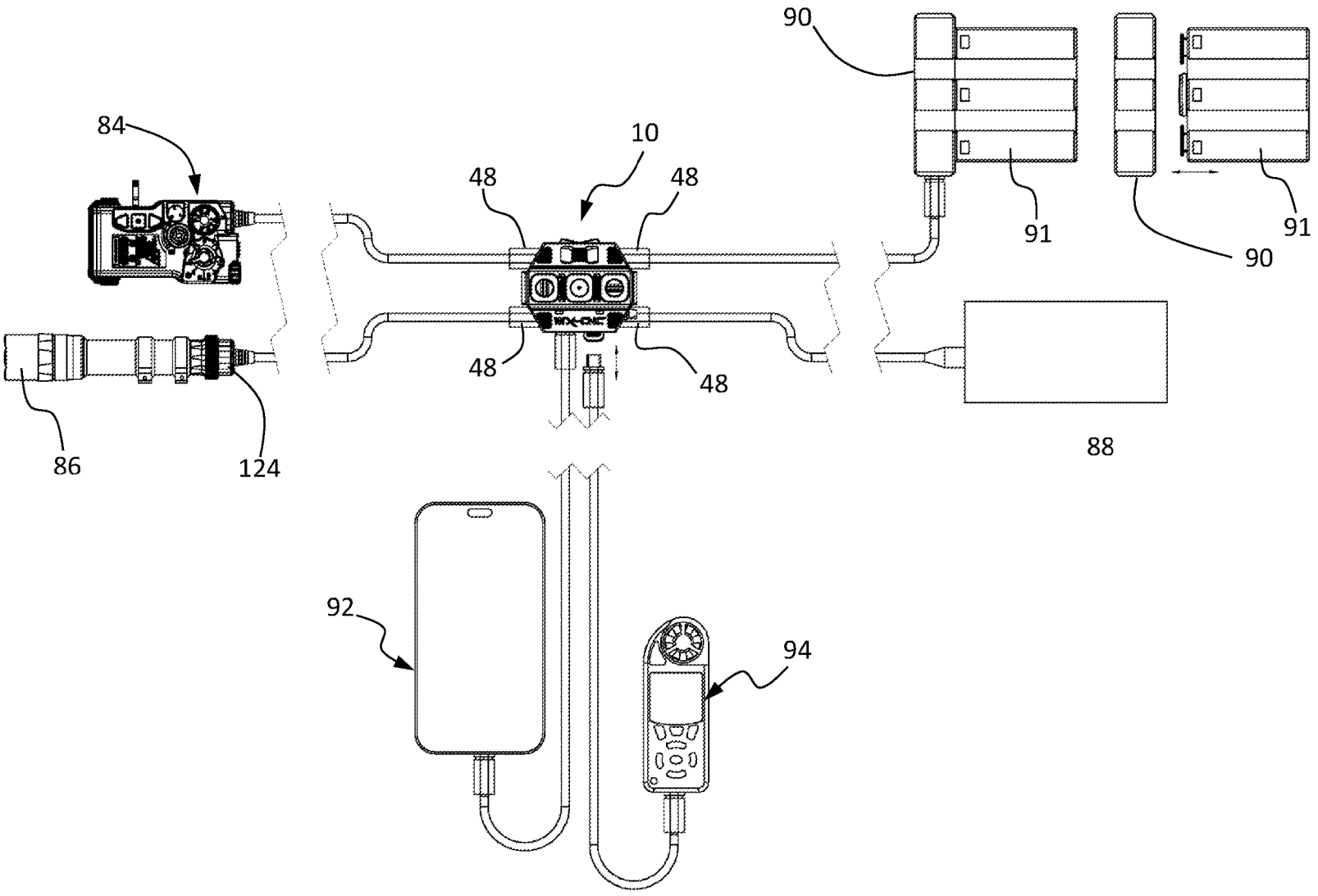
FIG. 8 provides an overview of the central network controller with four USB-C connectors attached.

FIG. 8 provides an overview of the central network controller 10 with four USB-C connectors 48 attached. Each connector 48 is capable of supplying and receiving power and data from a connected device. Attached cables are configurable to any connector type, including legacy connectors, proprietary connectors, and other non-standard connectors. In the illustrated embodiment the accessory devices include a laser/illuminator 84, a flashlight 86, and a camera 88. Examples of devices include, but are not limited to, weapon accessory devices in the Wilcox Xe product line. Other devices include but are not limited to radios, head up displays (HUDs), weapon-mounted optics, weapon-mounted targeting modules, end user device (EUD), and any device with a Crane-type port.

In the illustrated embodiment, a mobile computing device 92, such as a smartphone, is attached to one of the computer ports 14*b* and a ballistics computer/wind sensor 94 is attached to another one of the computer ports 14*b*. A power supply 90 is also attached to one of the ports 14*a* for supplying power to the connected devices as well for exchanging data and/or control signals between the connected devices. In the illustrated embodiment the power supply 90 comprises a small tactical universal battery (STUB) adapted configured to detachable a STUB battery pack 91.

Figure 9A:
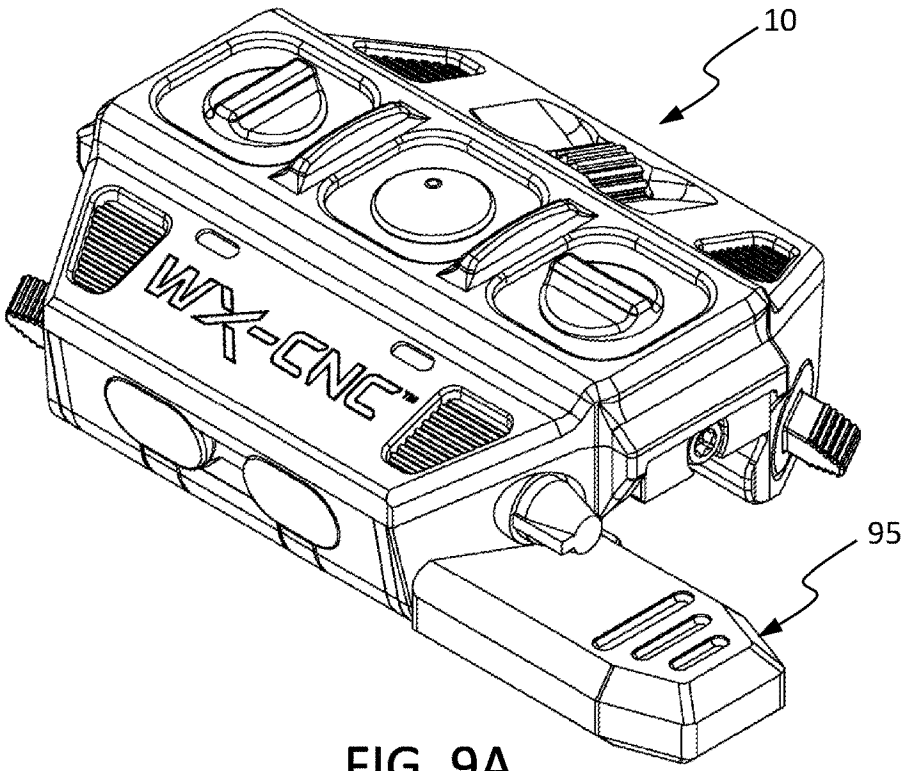
FIG. 9A is an isometric view of the central network controller appearing in FIG. 1, with a modular radio attachment attached to one of the locking USB-C connectors.
Figure 9B:
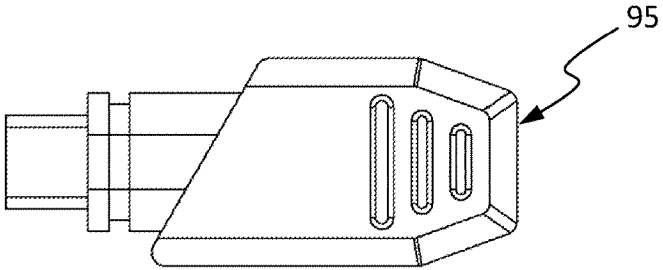
FIG. 9B is an enlarged view of the modular radio attachment appearing in FIG. 9.

Referring now to FIGS. 9A and 9B, and with continued reference to the remaining figures, the attached accessory devices may have wired and/or wireless capability. In FIGS. 9A and 9B, an attached accessory device 95 having an onboard radio transceiver, e.g., a wireless radio dongle, is attached to one of the ports 14*a*. Alternately or additionally, data from a wired accessory device coupled to the unit 10 may be transferred to a remote device via an onboard radio transceiver 106 (see FIG. 10A) within the unit 10. In the illustrated embodiment of FIG. 9A, the central network controller 10 hosts the attached short-range radio module 95. In embodiments, the attachment 95 would allow the central network controller to integrate seamlessly into an intra-soldier wireless network (ISW).

Figure 10A:
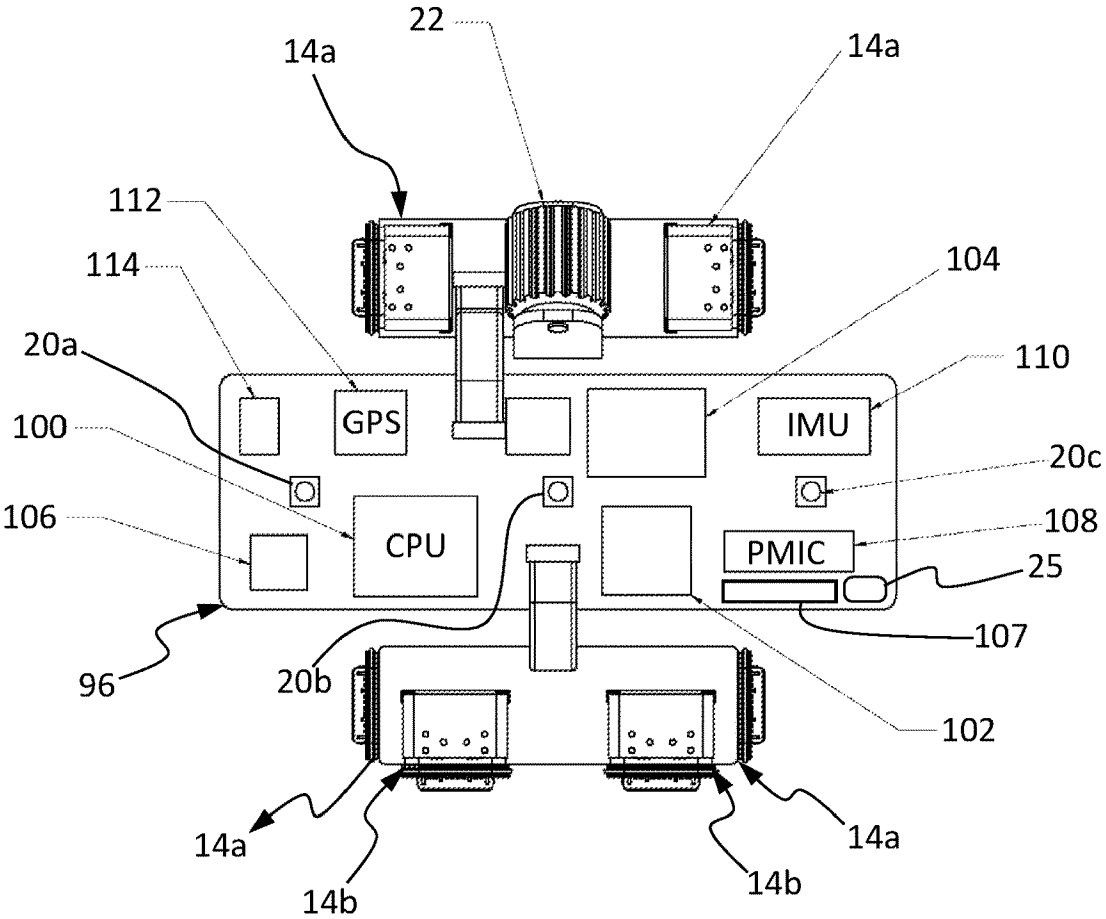
FIG. 10A is a top view illustrating the circuit components of the central network controller appearing in FIG. 1.

Referring now to FIGS. 10A and 10B, and with continued reference to the other figures, FIG. 10A is a top view illustrating a main circuit board 96 and the circuit components of the central network controller 10. The central network controller 10 hosts a processor 100, e.g., a central processing unit (CPU), microprocessor, microcontroller, or the like, and electronic memory 102 operably coupled to the processor 100. An inertial measurement unit (IMU) 104 is also provided, which comprises, for example, a three-axis accelerometer. A short-range radio frequency (RF) transceiver 106, e.g., a Bluetooth, NFC, or Wi-Fi module, is also provided on the main board 96. A cellular modem 105 (e.g., 3G, 4G LTE, 5G, etc.) is provided, e.g., to couple the device 10 to a cellular service provider so that a wide area network connection may be obtained.

A laser driver circuit 107 controls laser driver parameters, such as laser output power, coding, pulsing, etc. An image signal processor (ISP) 109 processes raw, captured image sensor data (e.g., visible, infrared, thermal, SWIR, etc. sensor image data) into usable imagery for the viewer, e.g., for viewing, recording, streaming, and so forth.

In embodiments, user preferences concerning one or more operational settings of an attached accessory device are stored in the memory 102, wherein the attached device is configured to receive the user preferences from the unit 10. The term "user preferences" means data specified by a user that is specific to a user or a customizable configuration representative of how a particular user chooses to configure the attachable devices while utilizing the apparatus as described herein. User preferences for one or more accessory devices may be saved or periodically updated using a computing device attached to the unit 10, such as a smartphone or other mobile device.

In certain embodiments, when an accessory device is attached to the unit 10, the accessory device is identified by the unit 10. The unit 10 then loads the user preference profile for the attached device. Such identification may be performed via a number of methods. For accessory devices that have their own control system, the unit 10 may query the accessory device for identification data. Alternatively, including but not limited to devices that do not have an onboard control system, and especially where an accessory device uses a device specific cable, device identification data may be determined from the cable itself. For example, in certain embodiments, an electronic memory such as PROM, EPROM, EEPROM, and so forth, stores device-identifying information which is readable by the unit 10 when the accessory device is attached. Alternatively, circuit components such as a resistor may be provided in the cable to allow the unit 10 to identify an attached device, e.g., based on the value of the resistor or other circuit component.

In certain embodiments, each of the computer ports 14*a*, 14*b* is preprogramed by the user for a specific accessory device. In certain embodiments, a visual indicator, such as one or more LEDs, is provided to provide a visual indication of which devices are attached to which ports. In embodiments, the LED indicator(s) is housed within the housing 16 and is configured to emit light through an opening or a transparent or translucent portion of the housing. In certain embodiments, the LED indicator is housed within the recess 42 and is viewable though an opening in an attached one of the adapter plates 40*a*-40*f*. In certain embodiments, the LED indicator is a multispectral LED wherein a different color is used to identify each port, for example, blue=Port 1, red=Port 2, yellow=Port 3, white=Port 4, green=Port 5, violet=Port 6.

A power management integrated circuit (PMIC) 108 is provided for power management, such as voltage conversion and the like. The illustrated embodiment includes the four sealed USB-C connectors 14*a*, three keypad buttons 20*a*, 20*b*, and 20*c*, and the depressible scroll wheel 22. In some instances, the system may contain other radios 110, such as ultra-wide band, Near Field Magnetic Induction, and a satellite-based positioning system, such as a Global Positioning System (GPS) receiver 112. In certain embodiments, a video recorder module 114 is also provided on the main board 96.

In embodiments, the IMU 104 serves multiple purposes including recording shock events, e.g. gunfire, which could then be logged either in the memory 102 of the CNC or other device or software application, as well as determining the pose and/or orientation of the system (azimuth and inclination).

Additionally, modular wireless radios such as the radio dongle 95 can be attached to the USB-C connectors 14*a* to allow for maximum modularity and for the user to adapt to various wireless radios, antennas, etc., to the system Referring now to FIGS. 11A-11D, and with continued reference to the other figures, there are illustrated some exemplary adapter cables for coupling accessory devices to the central network controller 10. In embodiments, the ports 14*a* on the central network controller housing 16 can accept any type of adaptor attachment to support any mission type. For example, the cables allow the on board ports to be converted to a Fisher, Omnetics, Wilcox, Crane, or any other connector style required.

Figure 11A:
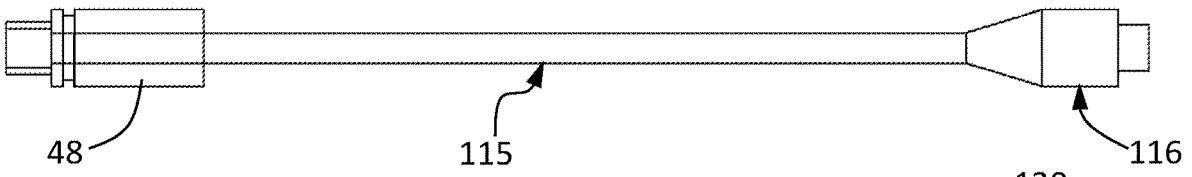
FIGS. 11A-11D illustrate exemplary adapter cables for coupling accessory devices to the central network controller herein.

FIG. 11A illustrates an exemplary cable 115 having a first end having a connector 48 as described above for engaging a port 14*a* and a second end having a connector 116, which may be a proprietary connector type or an industry-standard connector type. Exemplary proprietary connector types include Fisher, Omnetics, Wilcox, Crane, and others. Exemplary industry standard connector types include, for example, USB-A, USB-B, USB-C, Mini USB, Micro USB, Lightning, and the like.

Figure 11B:
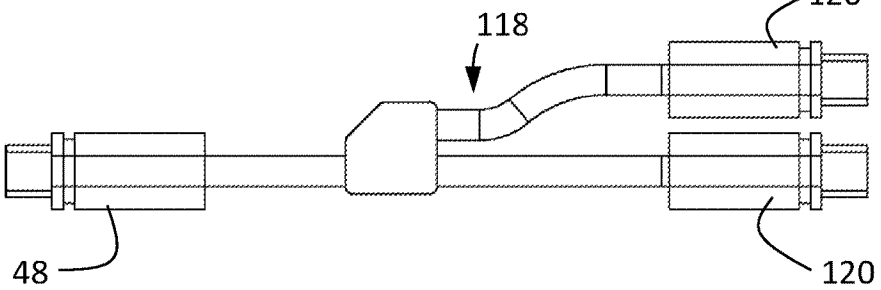

FIG. 11B illustrates an exemplary cable 118 having a first end having a connector 48 as described above for engaging a port 14*a* and a second end having dual connectors 120, which are illustrated as being locking USB-C connectors as described above by way of reference to the connector 48, although it will be recognized that the dual connectors 120, which may be the same or different, may be other types of connector.

Figure 11C:
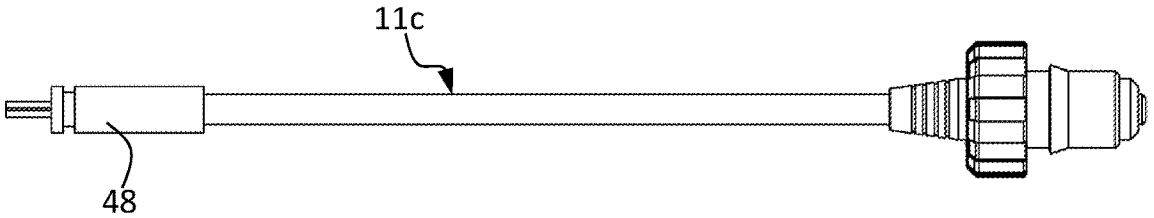
Figure 11D:
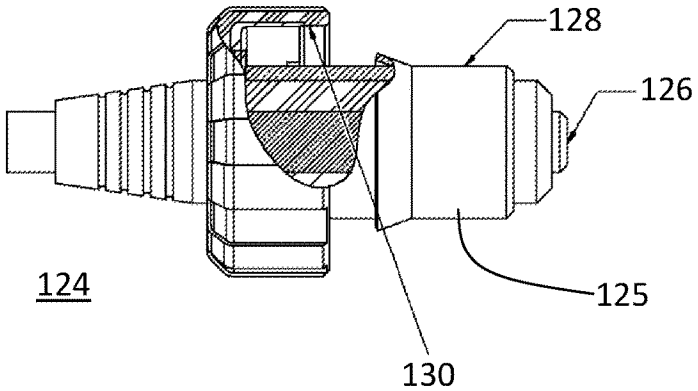

FIG. 11C illustrates an exemplary cable 122 having a first end having a connector 48 as described above for engaging a port 14*a* and a second end having battery power plug 124, which is a so-called battery eliminator or battery replacement adaptor configured to provide power to legacy battery powered devices via a battery compartment on the legacy device. FIG. 11D is an enlarged view of the connector 124. The connector 124 in the illustrated embodiment is adapted for a CR123-style battery tube. It will be recognized, however, that other the connector plug 124 may be adapted for other battery types. The plug 124 includes a battery dummy 125 having positive and negative terminals 126, 128 and a cap or cover portion 130 configured to replace a battery cover, e.g., a threaded or cam-locking battery cover, on the accessory device to be powered. In the illustrated exemplary embodiment, the battery dummy 125 is configured to fit CR123a style battery tubes, although it will be recognized that the illustrated embodiment can be adapted to fit other style battery tubes.

Figure 12C:
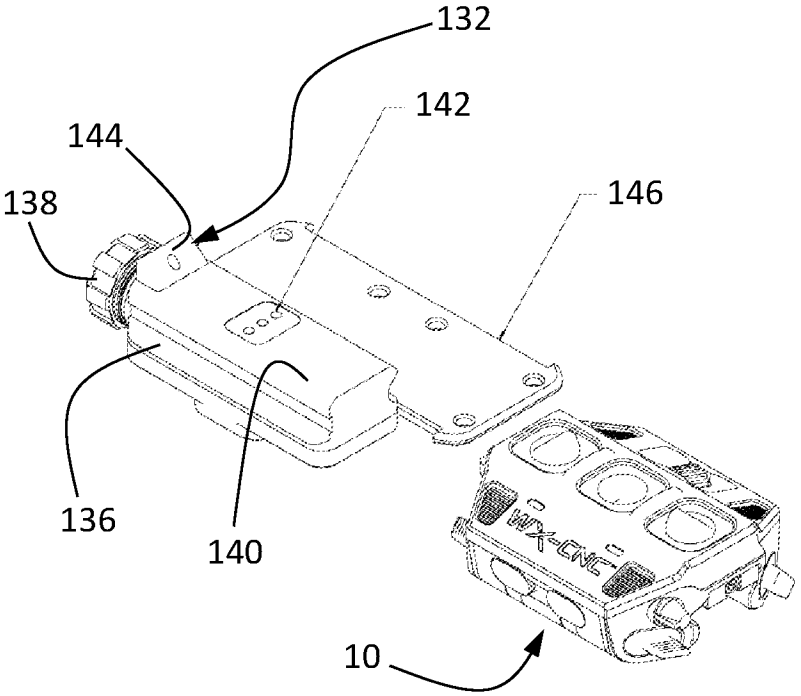
FIGS. 12A-12C illustrate a central network controller in accordance with FIG. 1 in combination with a mounting adapter for attachment to a webbing attachment system.
Figure 12A:
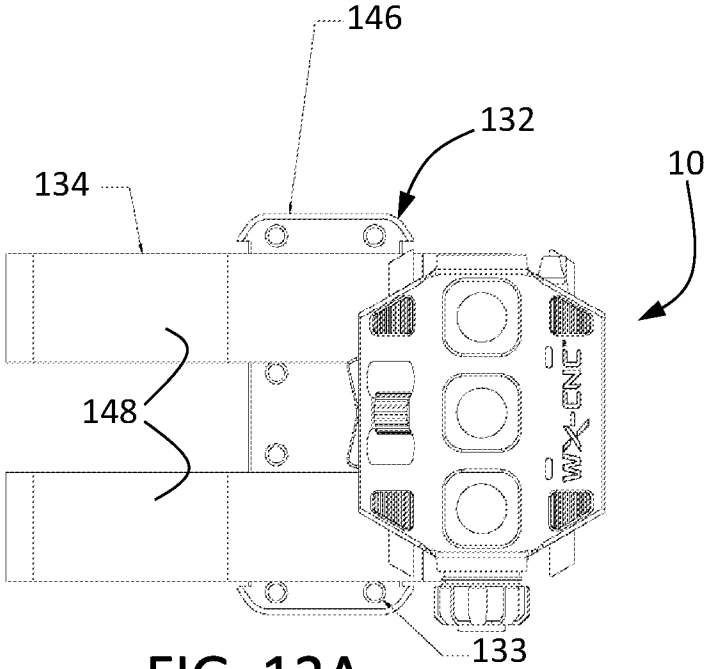
Figure 12B:
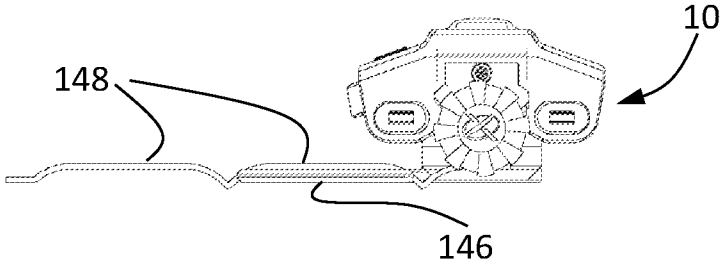
Figure 13A:
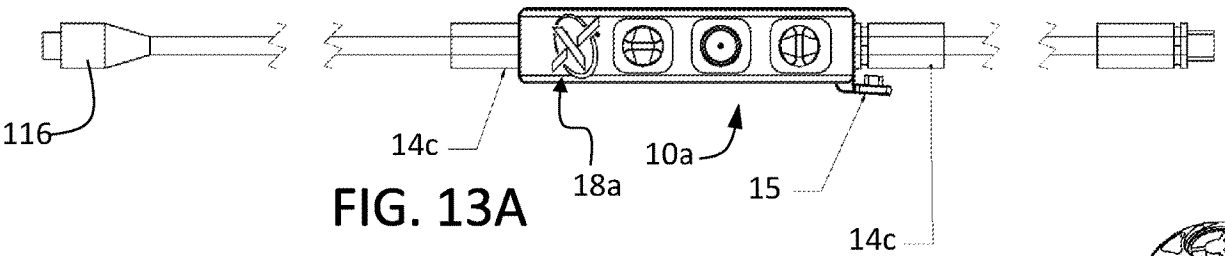
FIGS. 13A-13E illustrate a more compact central network controller having three USB-C ports in accordance with a second embodiment of the present disclosure.
Figure 13B:
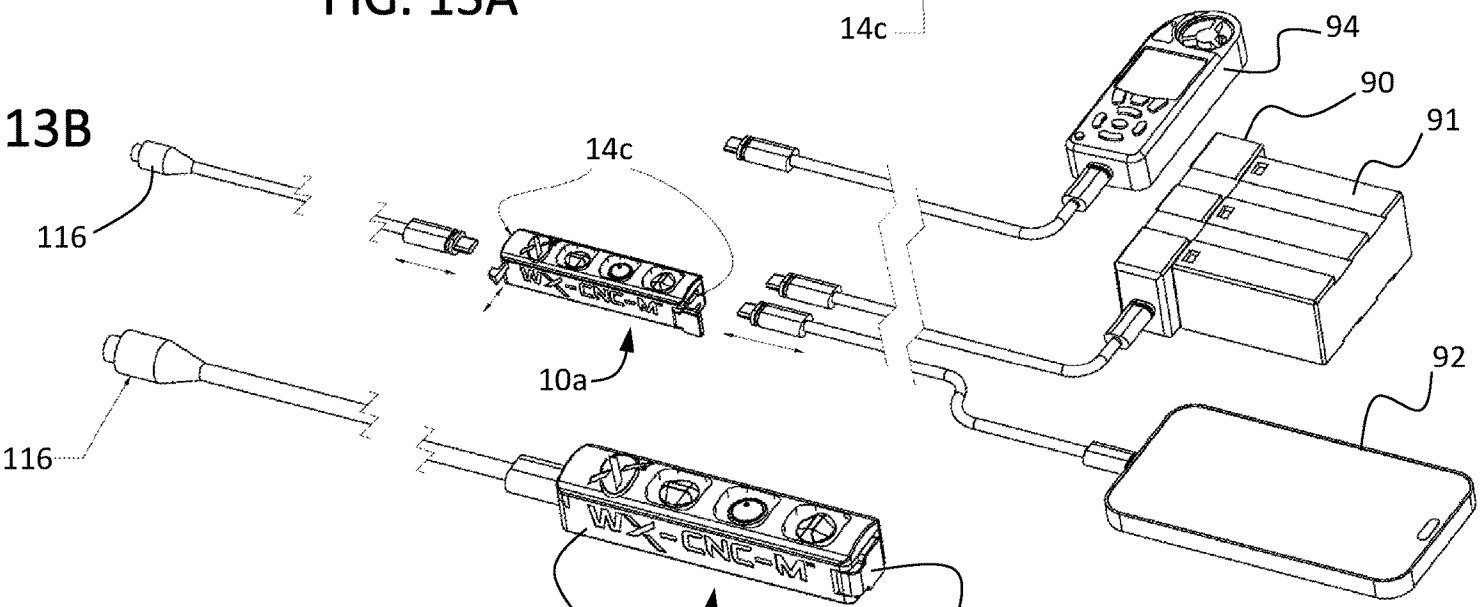
Figure 13C:
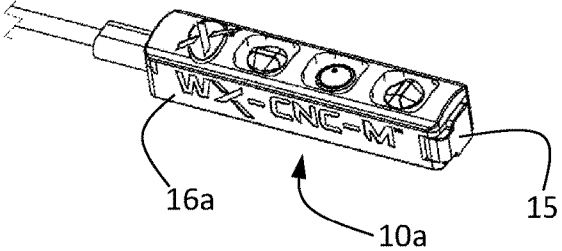
Figures 13D, 13E:
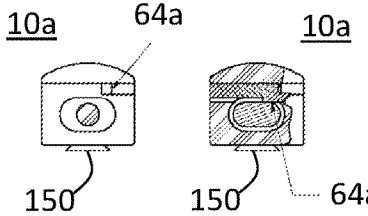

Referring now to FIGS. 12A-12C, and with continued reference to the other figures, there appears a mounting adapter assembly 132 for attaching the unit 10 to a webbing system 134, such as a Pouch Attachment Ladder System (PALS), Modular Lightweight Load-Carrying Equipment (MOLLE) system, All-Purpose Lightweight Individual Carrying Equipment (ALICE) system, or the like. This enables the central network controller 10 to be mounted to a plate carrier, chest rig, or other wearable equipment to provide network functionality to body mounted devices.

In certain embodiments, the device 10 is configured to connect via a wireless interface to body-worn systems. In certain embodiments, the device 10 is configured to control body worn devices via cables or wireless interface when it is mounted on a user's vest or other garment or wearable.

The adapter assembly 132 includes a battery housing 136 for receiving a battery. In embodiments, the battery is configured to be an internal backup battery. Access to the battery compartment is via a removable cap 138. The battery is electrically coupled to the unit 10 via electrical contacts 142 which engage contacts on a corresponding power adapter, such as the power adapter 40*d*.

The housing 136 includes mounting rail portion 140 having a cross-sectional shape that corresponds to a Picatinny rail profile and which slidably engages the channel 66 defined by the controller housing 16. A wedge member 144 engages the wedge member 76 to provide a wedge lock for securing the unit 10 on the rail portion 140. The mounting adapter assembly 132 further includes an adapter plate 146 for detachably securing the mounting adapter assembly 132 to adjacent rows of webbing 148 in the webbing attachment system 134. In embodiments, shock cord holes 133 are provided on the adapter plate 146, e.g., for additional attachment options and/or for attaching shock cords or bungee cords to secure, stabilize, and minimize movement of the unit 10.

Referring now to FIGS. 13A-13E, and with continued reference to the other figures, there is shown a compact central network controller 10*a* having a first computer ports 14*c* at one end and two computer ports 14*c* at a second end, in accordance with a second embodiment of the present disclosure. The illustrated embodiment 10*a* includes three USB-C ports 14*c*. The ports 14*c* have removable, and preferably hinged or tethered, dust covers 15. The embodiment appearing in FIGS. 13A-13E is advantageously used, for example, when a lower profile device is required by a given mission set. The unit 10*a* includes a housing 16*a* having a three button keypad 18*a* comprising three buttons 20*d*, 20*e*, and 20*f*, which may be as described above by way of reference to the buttons 20*a*, 20*b*, and 20*c*. In embodiments, the ports 14*c* are locking ports, which releasably locks the connector ends 48 via a locking pin 64*a* that engages the groove 58 and which is manually slidable to lock and unlock the connector 48 within the port 14*c*. A dovetail member 150 is provided to attach the unit 10*a* to a rail fastener assembly. An exemplary rail fastener assembly 152 is shown in FIGS. 14C and 14D.

Figure 14A:
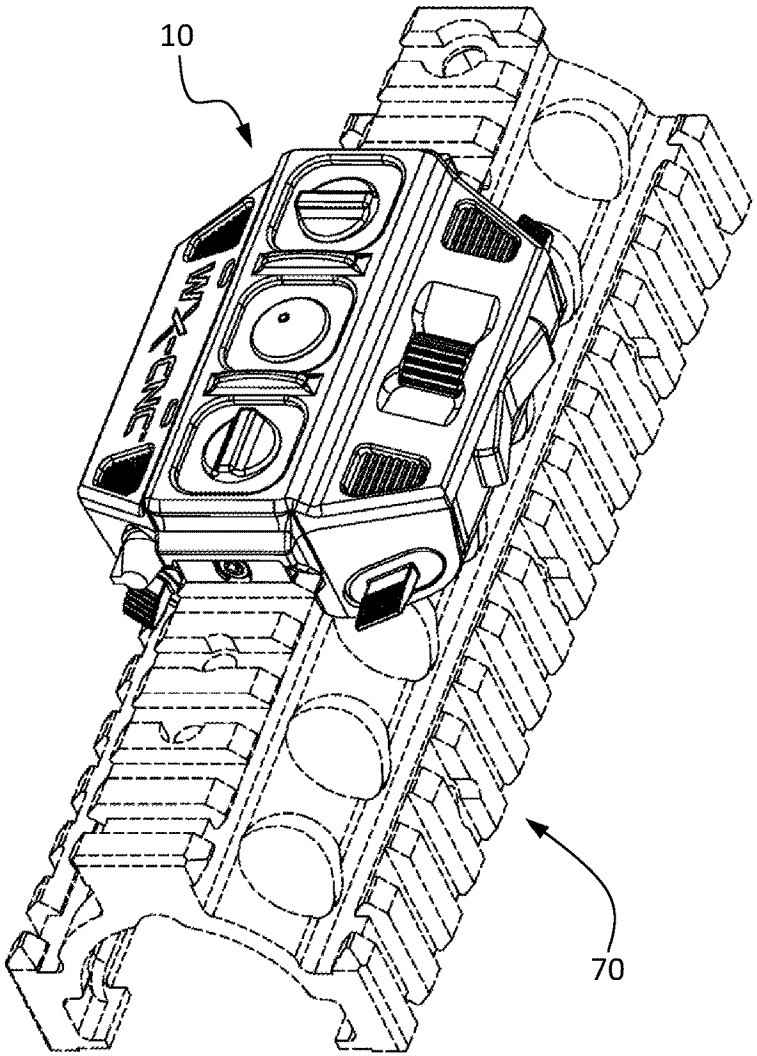
FIGS. 14A and 14B are isometric and side views, respectively, of the central network controller of FIG. 1 mounted to the upper rail of a MIL-STD 1913 Picatinny rail system.
Figure 14C:
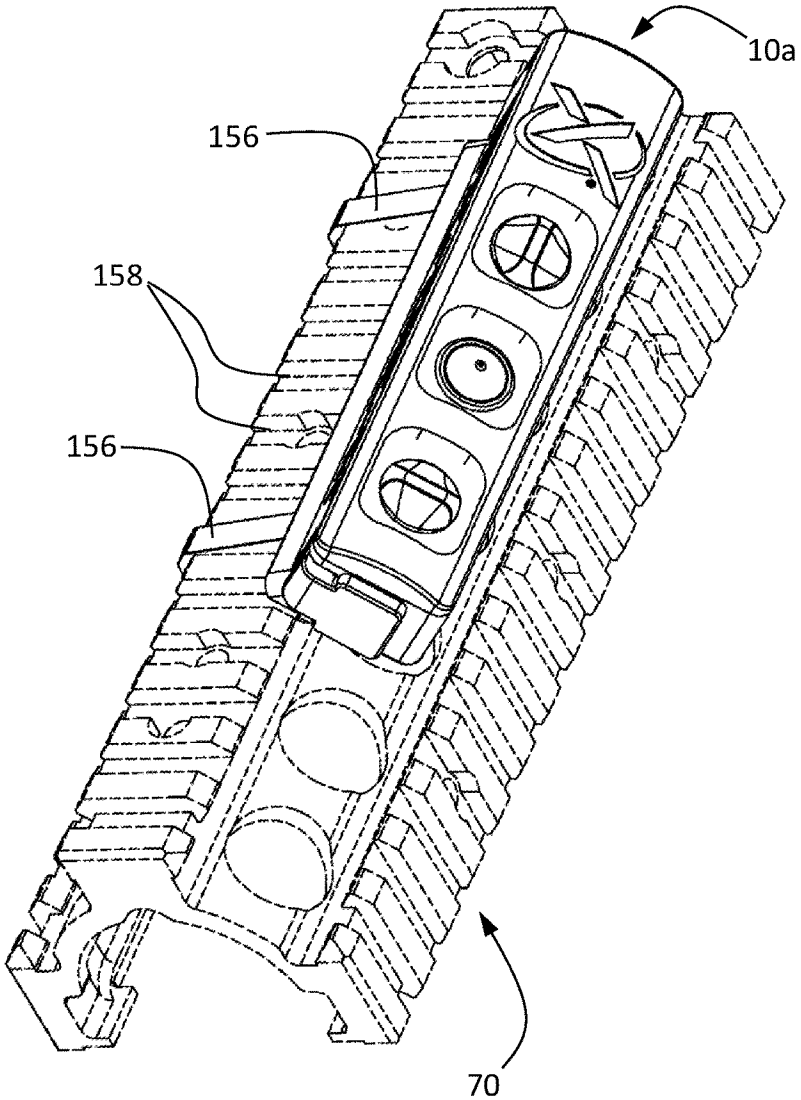
FIGS. 14C and 14D are isometric and side views, respectively, of the central network appearing in FIGS. 13A-13E mounted to the upper rail of a MIL-STD 1913 Picatinny rail system.
Figure 14B:
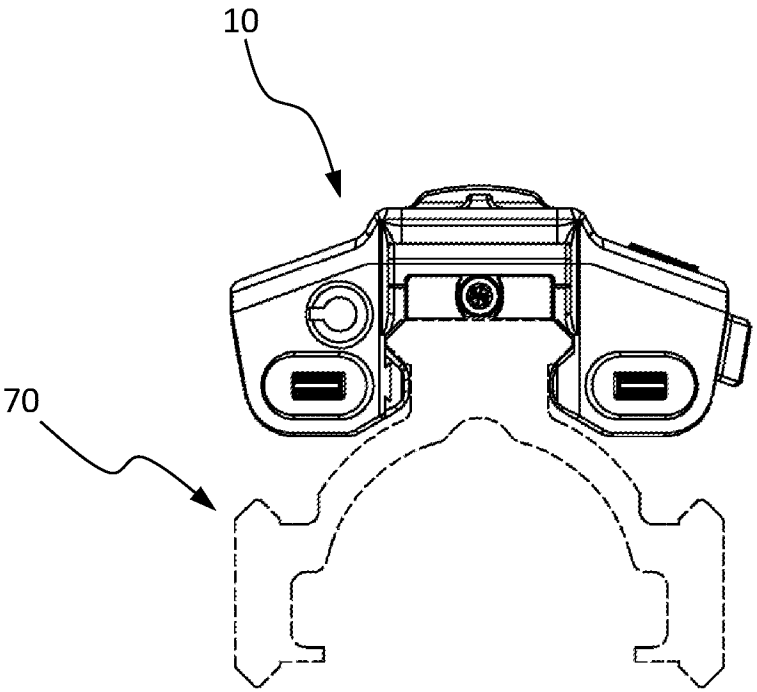
Figure 14D:
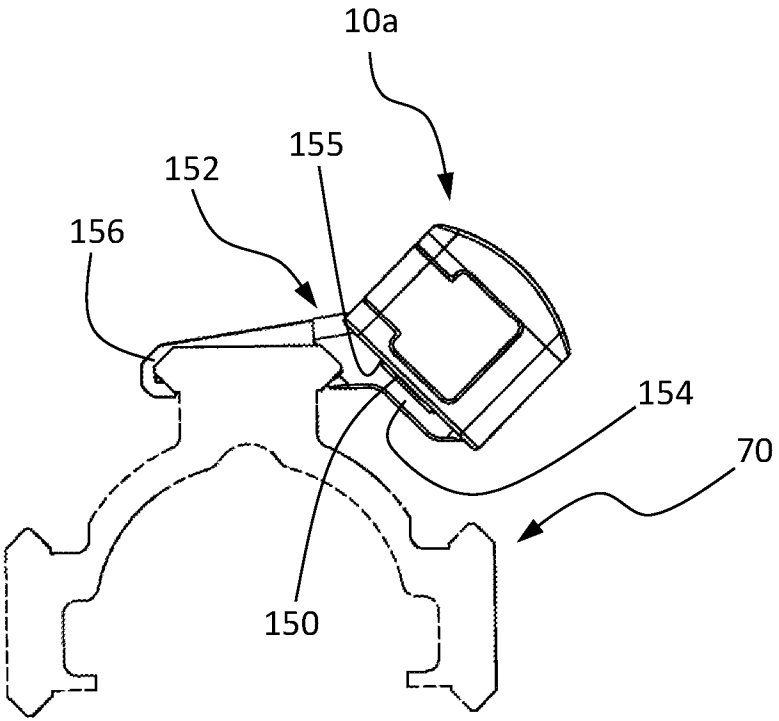

Referring now to FIGS. 14A-14D, and with continued reference to the other figures, FIGS. 14A and 14B show the central network controller 10 mounted to an upper quadrant rail of MIL-STD 1913 Picatinny rail system 70, illustrating the low profile due to its saddlebag form factor. FIGS. 14C and 14D illustrate the network controller unit 10*a* mounted to the upper quadrant rail of a MIL-STD 1913 Picatinny rail system 70. The network controller unit 10*a* is secured to a rail fastener assembly 152 via the dovetail fastener 150. The rail fastener system includes a base 154 having a slot 155 slidably receiving the dovetail member 150. The base is secured to the rail interface 70 using rail hooks 156 which engage transverse recoil grooves 158 in the rail interface 70. The rail hook fastener system may be as described in commonly owned U.S. patent application publication 2022/0412696, published Dec. 29, 2022 (U.S. application Ser. No. 17/834,208 filed Jun. 7, 2022), the entire contents of which are incorporated herein by reference in its entirety. As best seen in FIG. 14D, in embodiments, the unit 10*a* is positioned in-between adjacent quadrant rails to provide a low profile and ease of access to the keypad 18*a*.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A central network controller for a weapon, comprising:

a plurality of computer ports for attaching electronic weapon accessory devices, each of said computer ports configured to permit interchangeable use of the electronic weapon accessory devices on a weapon;

a processor and an associated electronic memory operably coupled to the plurality of computer ports;

one or more input devices operably coupled to the processor and configurable to control operation of an attached one or more of said electronic weapon accessory devices;

the central network controller configured to permit communication between the electronic weapon accessory devices and the processor to permit control of the electronic weapon accessory devices based on input from the one or more input devices; and the central network controller configured to facilitate electronic communication between the electronic weapon accessory devices by mediating transmission of signals between the electronic weapon accessory devices.

2. The central network controller of claim 1, wherein the one or more input devices comprise one or more devices selected from the group consisting of a scroll wheel, button-integrated scroll wheel, rocker switch, keypad, multi-position selector switch, and rotary selector switch, and any combination thereof.

3. The central network controller of claim 1, further comprising one or more port covers, each of the one or more port covers operable to selectively cover one of the computer ports.

4. The central network controller of claim 1, wherein the plurality of computer ports includes one or more locking ports, each of the one or more locking ports comprising:

a socket defining a receptacle in a housing of the central network controller, the socket configured to receive a complementary plug;

a manually actuatable button disposed on the housing;

a spring bearing against the button and captured within the housing;

a latch member attached to the button movable into and out of the receptacle, wherein the latch member is urged into the receptacle by the spring and wherein the latch member is movable out of the receptacle when the button is pressed to compress the spring;

wherein the latch member is configured to engage a complementary groove on the complementary plug when the complementary plug is inserted into the socket to provide a secure engagement of the computer port within the socket.

5. The central network controller of claim 4, wherein the complementary plug is selected the group consisting of an electrical connector of an accessory connector cable and a port cover.

6. The central network controller of claim 4, further comprising a sealing ring disposed within the receptacle.

7. The central network controller of claim 1, further comprising a radio frequency module configured to interface with a wireless weapon accessory device.

8. The central network controller of claim 1, further comprising one or both of a microphone and an audio speaker.

9. The central network controller of claim 1, wherein the central network controller is operable via voice command.

10. The central network controller of claim 1, further comprising a housing defining a channel having a cross-sectional shape which substantially matches a cross-sectional profile of a weapon accessory rail interface.

11. The central network controller of claim 10, wherein the channel has a cross-sectional shape which substantially matches a cross-sectional profile of a Picatinny accessory rail interface.

12. The central network controller of claim 10, further comprising a removable retaining bar axially extending within the channel.

13. The central network controller of claim 10, further comprising electrical contacts disposed within the channel, the electrical contacts positioned to make contact with electrically conductive elements disposed on an associated weapon accessory rail interface when the central network controller is installed on the associated weapon accessory rail interface.

14. The central network controller of claim 10, further comprising a first removable rail adapter module attachable to the housing within the channel, the first removable rail adapter module having a first configuration of electrical contacts, the first configuration of electrical contacts positioned to make contact with electrically conductive elements disposed on a first powered weapon accessory rail interface when the central network controller is installed on the first powered weapon accessory rail interface.

15. The central network controller of claim 14, further comprising a second removable rail adapter module attachable to the housing within the channel, the second removable rail adapter module interchangeably attachable in place of the first removable rail adapter module, the second removable rail adapter module having a second configuration of the electrical contacts positioned to make contact with electrically conductive elements disposed on a second powered weapon accessory rail interface when the central network controller is installed on the second powered weapon accessory rail interface.

16. The central network controller of claim 15, further comprising a removable blanking plate adapter module attachable to the housing within the channel, the removable blanking plate adapter module interchangeable with the first and second removable rail adapter modules, the removable blanking plate adapter module configured to be installed on the housing when the central network controller is mounted on a non-powered weapon accessory rail interface mechanical, non-electrical mount, said blanking plate having no electrical contacts.

17. The central network controller of claim 14, further comprising a second removable rail adapter module attachable to the housing within the channel, the first removable rail adapter module having an induction coil positioned to facilitate inductive power transfer with an induction coil on a second powered weapon accessory rail interface when the central network controller is installed on the second powered weapon accessory rail interface.

18. The central network controller of claim 10, further comprising:

a first inclined surface disposed on the housing;

a wedge having a second inclined surface facing and configured to engage with the first inclined surface;

a threaded fastener passing through a clearance opening in the wedge and threadably engaging a tapped opening disposed within the housing, wherein advancing the threaded fastener adjusts a position of the wedge relative to the first inclined surface on the device housing for facilitating wedge locking between the housing and the weapon accessory rail interface.

19. The central network controller of claim 1, wherein each of the plurality of computer ports is a USB type C port configured to supply and receive power and data from connected ones of the electronic weapon accessory devices.

20. The central network controller of claim 1, further comprising one or more adaptor cables, each adapter cable having a first connector configured to interface with the plurality of computer ports and a second connector selected from the group consisting of legacy connectors, proprietary connectors, and non-standard connectors, and battery dummies.

21. The central network controller of claim 1, further comprising an adapter cable having a first end having a USB connector configured for connection to the central network controller and a second end having dual USB connectors, each USB connector being configured for connection to two electronic weapon accessory devices, wherein the adapter cable is adapted to facilitate simultaneous data communication between the central network controller and the electronic weapon accessory devices.

22. The central network controller of claim 1, further comprising a battery adapter and a battery.

23. The central network controller of claim 1, wherein the battery is a small tactical universal battery (STUB).

24. The central network controller of claim 1, further comprising a radio configured to be detachably coupled to one of said computer ports.

25. The central network controller of claim 1, further comprising a circuit board and one or more modules disposed on the circuit board, the one or more modules selected from the group consisting of an inertial measurement unit (IMU), a short-range radio frequency (RF) transceiver, cellular modem, laser driver circuit, image signal processor, GPS receiver, power management integrated circuit (PMIC), video recorder module, and any combination thereof.

26. The central network controller of claim 1, further comprising a mounting adapter assembly for attaching to a webbing attachment system, the mounting adapter assembly comprising:

a battery compartment for receiving a battery, the battery for supplying power to the central network controller, the battery compartment configured to be detachably coupled to a housing of the central network controller; and an attachment plate attached to the battery compartment, the attachment plate configured to be positioned behind a webbing structure of the webbing attachment system.

27. The central network controller of claim 1, further comprising:

a housing;

an axially extending dovetail disposed on the housing;

a rail fastener assembly including a base having an axially extending slot slidably receiving the axially extending dovetail and first and second axially spaced apart hooks configured to detachably engage a weapon accessory rail interface.

* * * * *